US005131467A

United States Patent [19]

Osborne et al.

[11] Patent Number: 5,131,467

[45] Date of Patent: Jul. 21, 1992

[54] SYSTEM FOR DEFLECTING THROUGH-THE-FLOWLINE TOOLS

[75] Inventors: John M. Osborne, Aberdeen, United Kingdom; William D. Loth, Surrey, England

[73] Assignee: Shell Oil Company, Houston, Tex.

[21] Appl. No.: 648,773

[22] Filed: Jan. 31, 1991

[30] Foreign Application Priority Data

Jan. 31, 1990 [GB] United Kingdom ..... 9002203

[51] Int. Cl.[5] ..... E21B 7/08

[52] U.S. Cl. ..... 166/117.6; 166/381

[58] Field of Search ..... 166/117.6, 117.5, 381, 166/342, 349

[56] References Cited

U.S. PATENT DOCUMENTS

| | | | |
|---|---|---|---|
| 2,839,270 | 6/1958 | McCune et al. | 166/117.6 |
| 3,545,489 | 12/1970 | Brown et al. | 137/610 |
| 3,599,711 | 8/1971 | Fowler | 166/0.5 |
| 3,664,376 | 5/1972 | Watkins | 137/625.68 |
| 3,866,628 | 2/1975 | Weber et al. | 166/351 X |
| 4,224,986 | 9/1980 | Rothberg | 166/72 X |
| 4,252,149 | 2/1981 | Dollison | 137/625.44 |
| 4,291,724 | 9/1981 | Miller | 137/555 |
| 4,312,378 | 1/1982 | Dollison | 137/625.44 |

FOREIGN PATENT DOCUMENTS

| | | |
|---|---|---|
| 80-01187 | 12/1978 | PCT Int'l Appl. . |
| 1293130 | 10/1972 | United Kingdom . |
| 1321684 | 6/1973 | United Kingdom . |
| 2027774 | 2/1980 | United Kingdom . |
| 2170579 | 2/1985 | United Kingdom . |

*Primary Examiner*—Terry Lee Melius

[57] ABSTRACT

A system for deflecting through-the-flowline ("TFL") tools from a main flowline into a selected branch line comprises a diverter tool which is movable through the main flowline until it locks itself near a selected branch line. The tool is equipped with a diverter head which orients itself in the main flow line such that smooth bore is formed from the main flowline in the branch line.

22 Claims, 4 Drawing Sheets

SYSTEM FOR DEFLECTING THROUGH-THE-FLOWLINE TOOLS

BACKGROUND OF THE INVENTION

The invention relates to a system for deflecting through-the-flowline ("TFL") tools from a main flowline into a selected branch line.

Large multi-well subsea oil and gas production systems are generally associated with a subsea manifold at which their production is commingled in a common main flowline which delivers the accumulated oil and gas production to a surface process facility.

At times it is necessary to undertake downhole maintenance of the wells using TFL tool pumpdown techniques. In such operations a tool designed to perform a specific function, such as replacement of a downhole component, is assembled in an articulated TFL tool string at the surface facility. The tool string is then inserted into a special lubricator at the surface facility and pumped via the main flowline into a selected branch line and the associated well.

Numerous systems have been developed for deflecting TFL tools from a main flowline into a selected branch line. U.S. Pat. Nos. 3,545,489; 3,599,711; 3,664,376; 4,252,149; 4,224,986; 4,291,742 and 4,312,378 and U.K. Patent Nos. 1,321,684 and 2,170,579 disclose permanently installed diverters that are able to deflect a TFL tool into a selected branch line. The disadvantages of these diverters are that they require provisions to facilitate maintenance of the diverter and its actuator and that means for remotely switching the diverter must be provided.

An object of the present invention is to remedy these drawbacks and to provide a system for deflecting TFL tools without permanently installed deflector assemblies such that a simple and cheap flowline system is created which requires a minimum of maintenance.

SUMMARY OF THE INVENTION

In accordance with one aspect of the present invention there is provided a system for deflecting TFL tools from a main flowline into a selected branch line, comprising a diverter tool which is movable through the flowline and which is equipped with:

- a locking mechanism for positioning the diverter tool in the main flowline at a predetermined position near the selected branch line;
- a wedge-shaped diverter head for guiding a TFL tool from the main flowline into the selected branch when the diverter tool is positioned at said location; and
- means for orienting the diverter head in a predetermined orientation in the main flowline such that a smooth bore is formed from the main flowline into the branch line when the tool is positioned at said location.

In accordance with another aspect of the present invention the system includes a flowline circuit for use with the diverter tool, the circuit comprising:

- a main flowline equipped with a lubricator for launching the diverter tool;
- a plurality of branch lines that are connected to the main flowline such that at the point of connection each branch line has a predetermined orientation relative to the main flowline; and
- a locking profile formed at the inner wall of the main flowline at a predetermined distance from each point of connection, said locking profile being shaped such that it is able to receive the locking mechanism of the diverter tool.

BRIEF DESCRIPTION OF THE DRAWINGS

The invention will be described in more detail with reference to the accompanying drawings, in which.

DETAILED DESCRIPTION OF THE PREFERRED EMBODIMENTS

Figure 1:
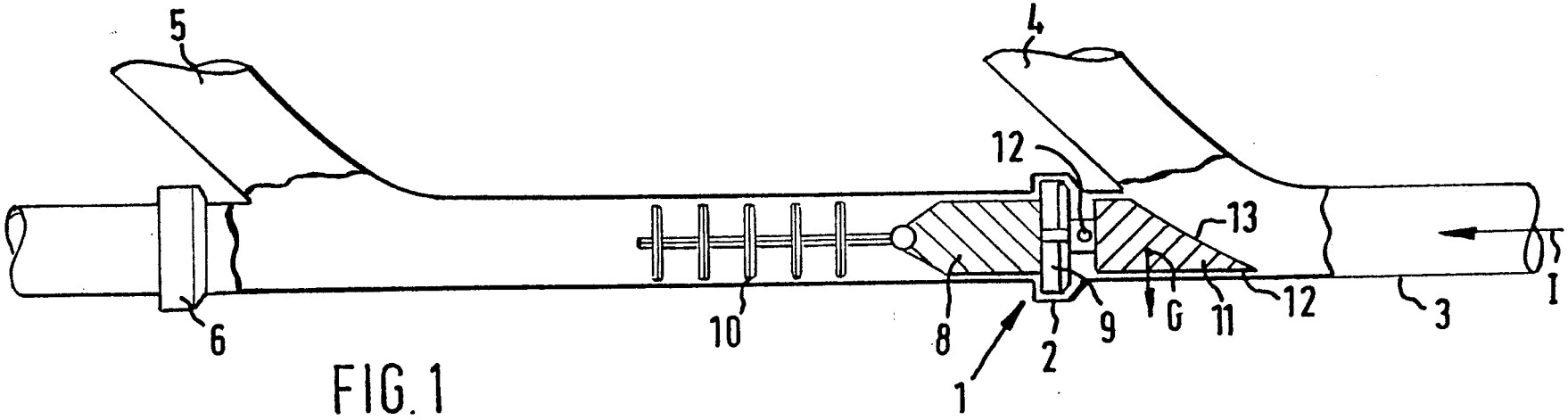
FIG. 1 is a partially sectioned view of a diverter tool and a section of a flowline circuit of a system for deflecting TFL tools according to the invention.

Referring to FIG. 1 there is shown a diverter tool 1, which is locked to a locking profile 2 in the main flowline 3 at a location near a first branch line 4. The shown section of the circuit further includes a second branch line 5 and a second locking profile 6 which is arranged in the main flowline at a location near the second branch line 5.

The diverter tool 1 comprises a torpedo-shaped central body 8 to which a segmented locking ring 9 of the locking mechanism is secured. In the situation shown the locking ring 9 is expanded within the locking profile 2 near the first branch line 4 such that any movement of the tool 1 in downstream direction is prevented.

A bidirectional TFL piston assembly 10 is pivotally secured to one end of the central body 8 for enabling pumping the tool 1 up and down through the main flowline 3. A wedge-shaped diverter head 11 is rotatably secured by a ball joint 12 to another end of the central body 1 for creating a smooth bore from the main flowline 3 into one of the branch lines 4, 5 when the tool 1 is locked by the locking ring 9 to one of the locking profiles 2, 6.

In FIG. 1 the plane of the drawing is a vertical plane of cross-section. Thus, the main flowline 3 has at each branch line offtake a substantially horizontal orientation whereas each branch line is upwardly oriented at an acute angle of inclination of about 30 degrees relative to the main flowline 3.

In use the diverter tool 1 is inserted into a lubricator (not shown) at the upstream end of the main flowline 3. The tool 1 is then pumped through this flowline 3 in the direction of the arrow I. A counter mechanism that will be described in more detail with reference to FIGS. 3A–3C counts the amount of branch lines that are being passed by the tool and this mechanism has been programmed such that the locking ring 9 expands within a locking profile 2 adjacent to a selected branch line 4.

The wedge-shaped diverter head 11 has an eccentric center of gravity "G" and is freely rotatable relative to the central body 8 so that the longest side 12 of the wedge lies against the bottom of the main flowline 3 and a smoothly curved frontal surface 13 forms a deflection shoe which deviates subsequently inserted TFL tools that are pumped through the main flowline 3 into the branch line 4 in front of the diverter head 11.

Figure 2B:
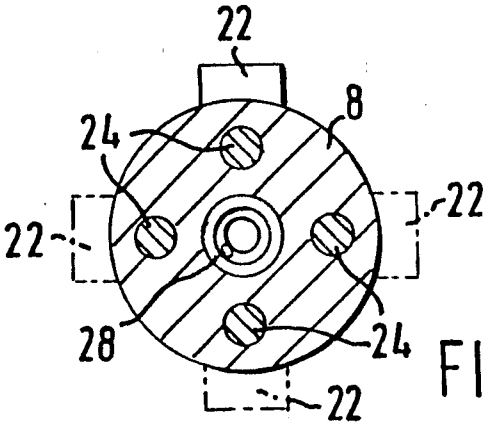
FIG. 2B is a cross-sectional view along line 2B—2B of FIG. 2A of the locking mechanism when seen in the direction of the arrows.
Figure 2A:
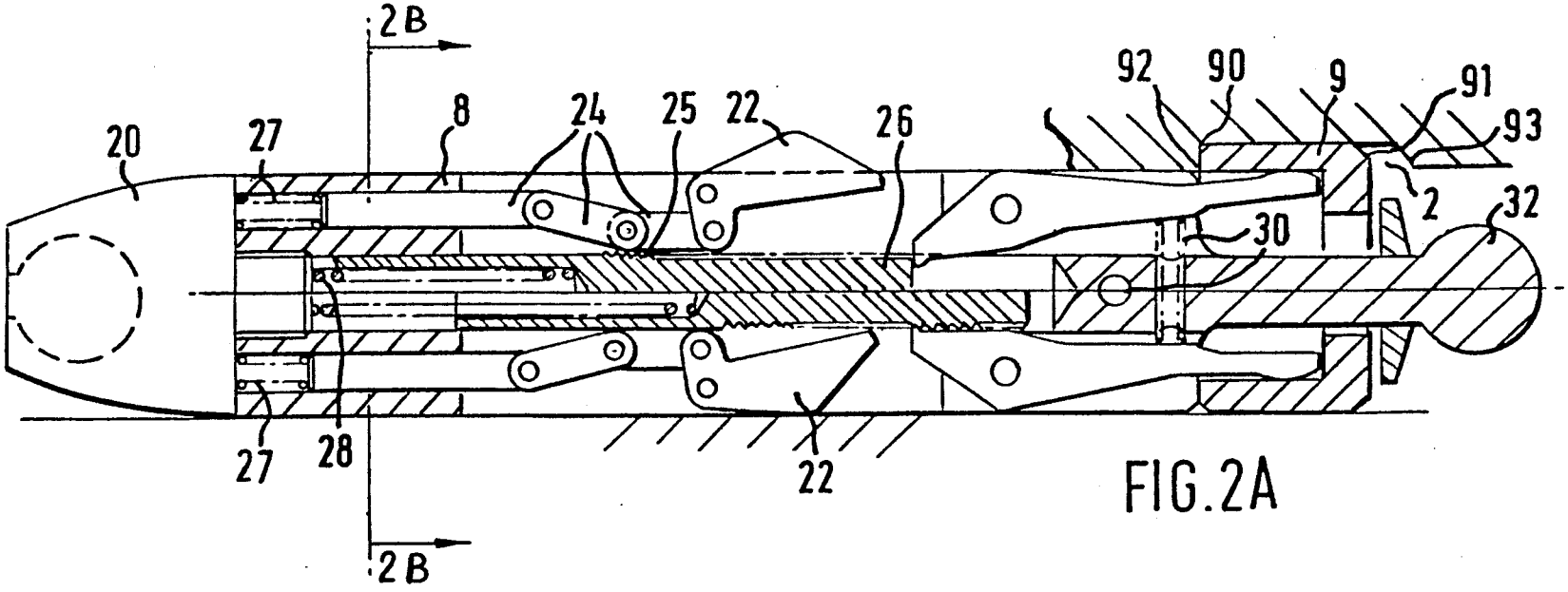
FIG. 2A is a longitudinally split sectional view of a locking mechanism of the diverter tool shown in FIGS. 1 and 2, the upper half of the mechanism being shown in an expanded position, the lower half being shown in a contracted position.
Figure 2C:
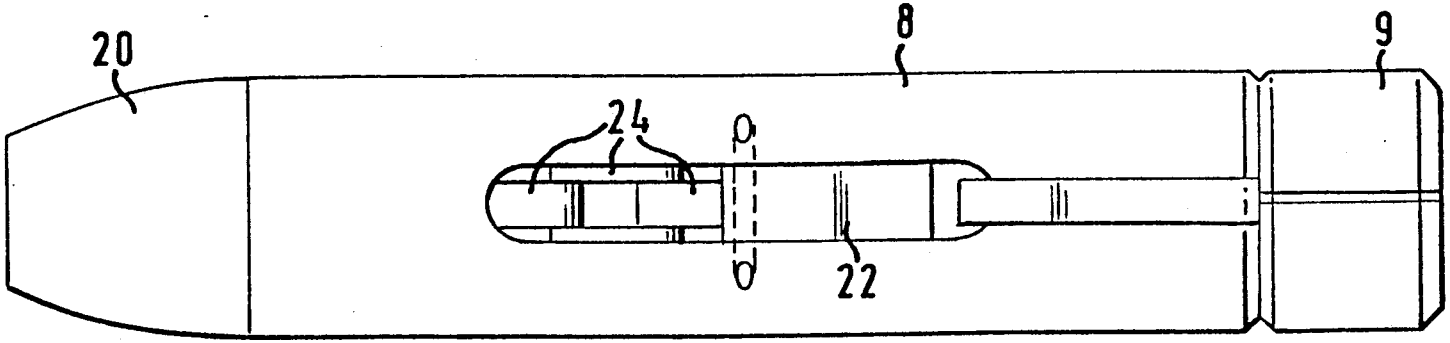
FIG. 2C is a top view of the locking mechanism of FIG. 2A.

FIGS. 2A-2C show the construction of a suitable counter mechanism for use in the diverter tool according to the invention.

FIG. 2A is a longitudinal sectional view of the central body 8 of the tool. In the upper half of this Figure the split locking ring 9 and one of the cams 22 are shown in an expanded position thereof while in the lower half of this Figure the locking ring 9 and one of the cams 22 are shown in their retracted position.

The central body 8 is equipped with a frusto-conical nose section 20 in which a ball joint (not shown) for connecting the body 8 to the TFL piston assembly is arranged.

The counter mechanism comprises four spring-loaded cams 22 that are connected via a linkage system 24 to a ratcher 25 on a central shaft 26.

Springs 27 push the cams 22 via the linkage system 24 towards an expanded position as shown in the upper half of FIG. 2A. The central shaft 26 is pulled by a tensioned spring 28 towards the nose section 20. The central shaft 26 is replacable and a kit of such shafts, each individually configured to a stop the diverter tool at the offtake of a specific branch line, will be required.

For example, if it required to stop the diverter tool at the seventh branch line a central shaft with a seven tooth ratcher 25 will be selected and mounted in the central body 8. On pumpdown through the main flowline the diverter tool will pass the offtake of the first six branch lines with one or two of the spring loaded cams being released at each offtake to move the central shaft 26 one tooth forward.

It is observed that the teeth of the linkage system 24 can slide over the ratcher in a direction away from the nose section 20 and that the depth of the locking profile 2 (see FIG. 1) near each branch line offtake is insufficient to fully release the cams 22 so that the ratcher is not activated when the cams 22 pass a locking profile. It is furthermore observed that it does not matter how many cams 22 are activated when the tool passes a branch line offtake as the ratcher will only advance by a single tooth in response to release of one or more cams 22 at the offtake.

On passing the seventh branch line offtake the teeth of the linkage system 24 have passed the seventh ratchet tooth of the ratcher 25 and the central shaft 26 is thus released to contract, i.e. to move towards the nose section 20 as shown in the upper half of FIG. 2A. This allows springs 30 to induce a set of four levers 31 to push the split locking ring 9 towards its expanded position. As soon as the locking ring 9 has reached a locking profile 2 it fully expands and blocks any further movement of the diverter tool in downstream direction.

The resulting rise in pumpdown pressure will indicate that the diverter tool has arrived its destination and is stalled inside the main flowline.

Figure 3:
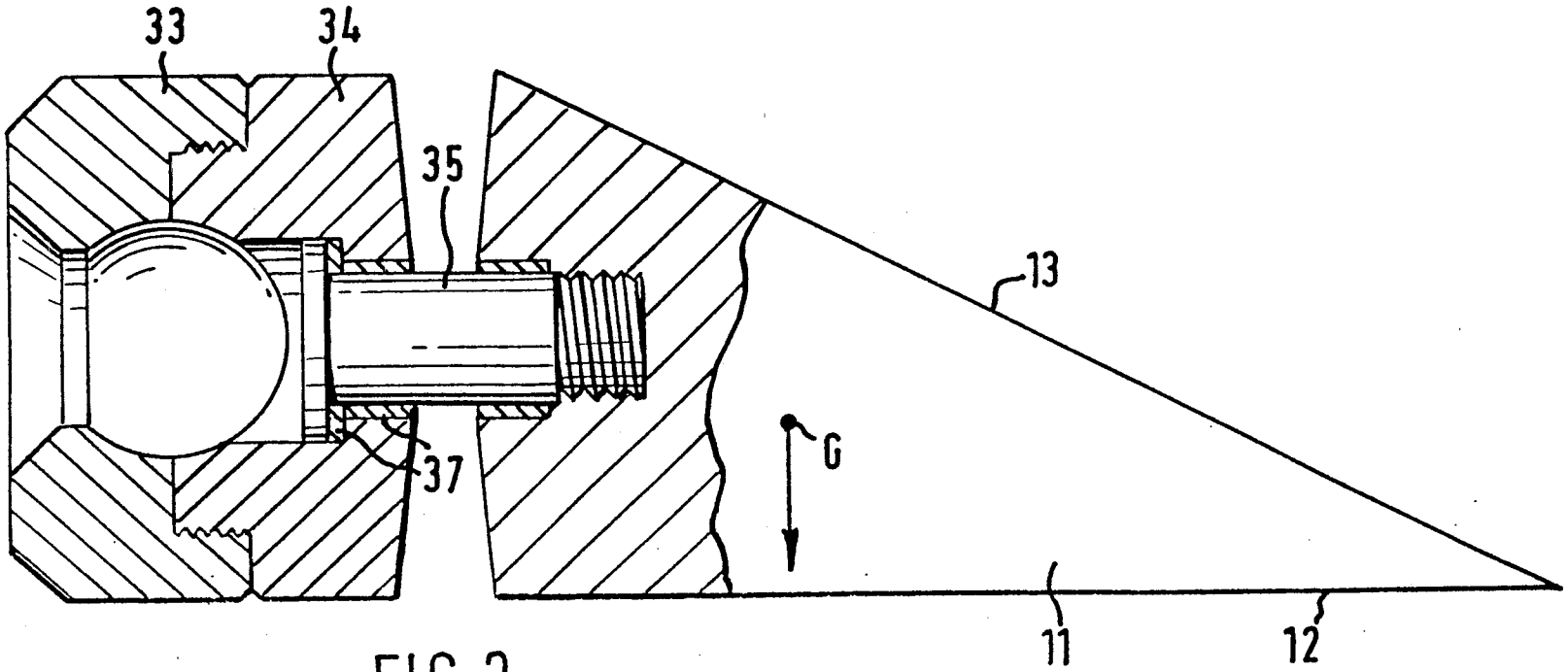
FIG. 3 is a longitudinal sectional view of a self-orienting diverter head of the diverter tool shown in FIGS. 1 and 2.

As shown in FIGS. 2 and 3 the diverter head 11 is connected to a ball joint 32 at the tail of the central body 8 via a set of connector rings 33, 34 and a connector pin 35. The connector rings 33 and 34 are screwed together such that they encase the ball joint 32 and thus form a universal joint. The connector pin 35 is at one end screwed to the diverter head 11 and passes at another end through a central bore in the connector ring 34.

Rings 37 of a low friction material ensure that the connector pin 35 and associated diverter head 11 can freely rotate relative to the connector rings 33, 34 and the central body 8. The tubular outer surface of the diverter head 11 may also be provided with a coating of a low friction material or with rollers (not shown) to ensure that the eccentric center of gravity G of the diverter head makes it self-orienting such that its longest side 12 always lies against the bottom of the main flowline 3 and its frontal surface 13 has an upward orientation.

Figure 4:
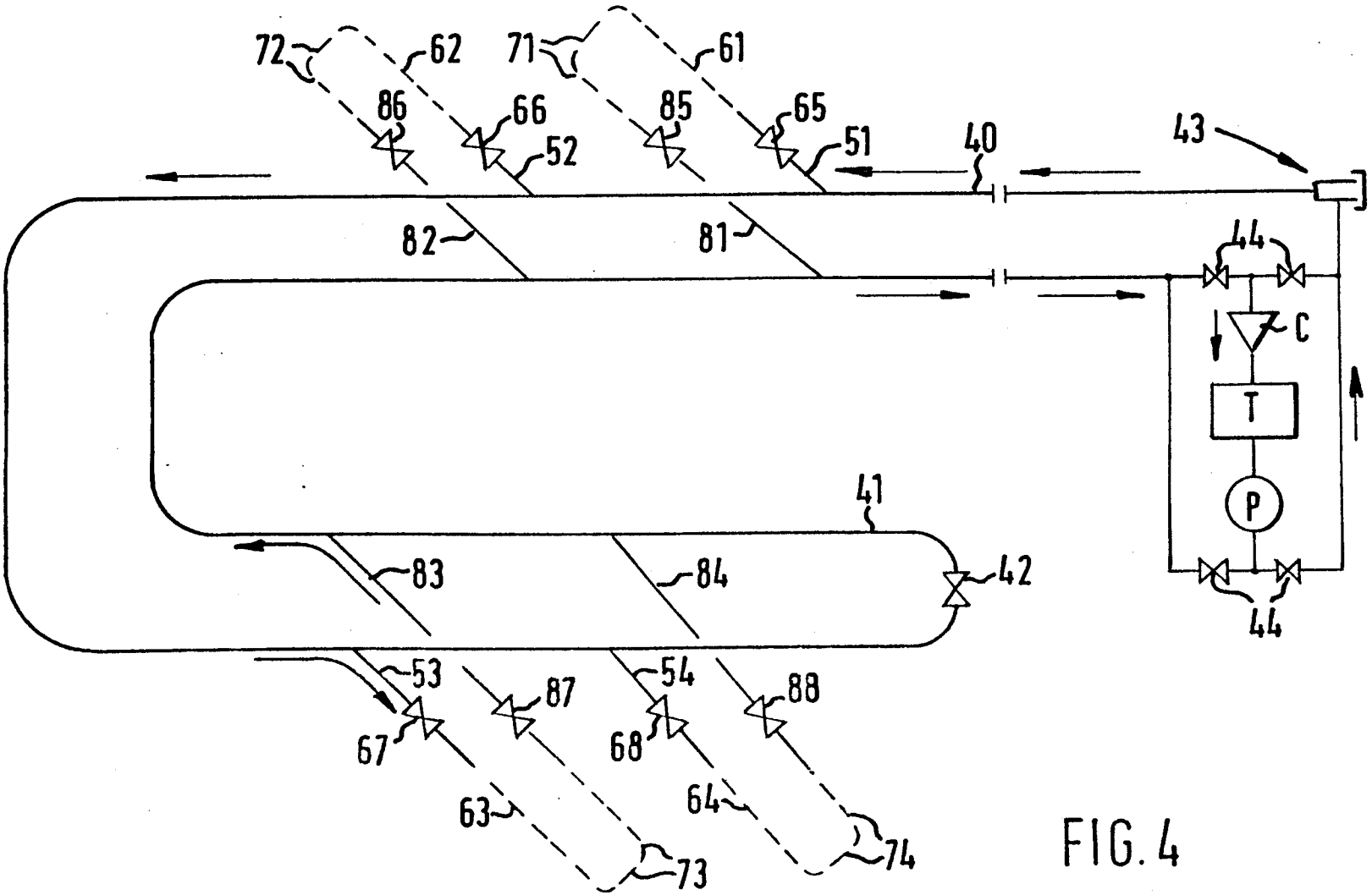
FIG. 4 is a schematic plan view of a flowline circuit in accordance with the present invention.

FIG. 4 shows schematically a suitable flowline circuit for use with the diverter tool shown in FIGS. 1-3. The circuit comprises a main flowline 40 which is connected at its downstream end to a return flowline 41 by means of a subsea valve 42.

The main flowline 41 is at its upstream end equipped with a lubricator 43 for inserting TFL assemblies into the circuit. The motive power for the toolstring is provided by a pump P connected into the lubricator, and drawing suction from a tank T. The return flowline 41 discharges into the same tank or to a separator train via a back pressure controller C. Interconnecting spools and valves 44 allow the direction of pumping to be reversed.

Four branch lines 51, 52, 53 and 54 are connected to the main flowline 40 such that at the points of connection the main flowline 40 has a substantially horizontal orientation at the seabed whereas the branch lines have an upward inclination. The branch lines 51-54 are each connected to production tubings 61-64 of four oil and/or gas production wells via wellhead valves 65-68, respectively.

The production tubings 61-64 are each at a downhole location connected to a circulation conduit 71-74. These circulation conduits are connected to offtake lines 81-84 via valves 85-88, respectively.

The offtake lines 81-84 are each connected to the return flowline 41. The thus created flowline circuit can be used to produce oil and/or gas from a subsea reservoir via underwater wells. The produced oil or gas is commingled in the main production line 40 via which it is delivered to a surface process facility which is usually mounted on an offshore platform.

If it is required to effect downhole maintenance in the production tubing 63 of the third well then a diverter tool equipped with a three teeth ratcher is inserted into the circuit via the lubricator 43.

Then all the wellhead valves 65-68 and 85-88 are closed and the subsea valve 42 is opened whereupon the diverter tool is pumped through the main flowline 40 by actuating the pump P. Once the diverter tool has passed the third branch line 53 the counter mechanism will actuate the split locking ring to expand into the locking profile (as shown in FIGS. 1 and 3A) adjacent to this branch line and blocks any further movement of the diverter tool in downstream direction through the main flowline 40. The resulting rise in pumpdown pressure will indicate that the diverter tool has arrived its destination.

A TFL tool string is then inserted into the circuit via the lubricator 43 and pumped through the main flowline 40 after the valves 67 and 87 of the third wellhead have been opened and the other wellhead valves and the subsea valve 42 have been closed.

The direction of the arrows indicates the direction of circulation of fluid through the circuit in that situation and as a result of the presence of the diverter tool near the offtake of the third branch line 53 the TFL tool string will be deflected via this branch line 53 into the production tubing 63 of the third well. When the TFL tool has reached its destination inside said production tubing 63 the tool will stall which is monitored at the surface by a resultant rise in pumpdown pressure.

The pumping direction is then reversed by manipulating the valves 44 such that fluid is circulated in a direction opposite to the direction of the arrows as a result of which the TFL tool moves up through the production tubing 63 and returns back to the lubricator 43 via the branch line 53 and the main flowline 40. After retrieval of the TFL tool string from the lubricator 43 the TFL diverter tool is recovered by first closing all the wellhead valves 65–68 and 85–88 and opening the subsea valve 42 and then continuing pumping fluid through the main and return flowlines 40, 41 in a direction opposite to the direction of the arrows.

It is noted that the still expanded locking ring does not block movement of the diverter tool in this direction because, as illustrated in FIG. 2A, the locking ring has a sharp downstream edge 90 and a smooth upstream edge 91. The locking profiles consist of annular grooves which also have each a sharp downstream edge 92 and a smooth upstream edge 93. The smooth upstream edge 91 of the split locking ring 9 and the smooth upstream edges 93 of the locking profiles 2 enable the recovery of the diverter tool in upstream direction through the main flowline while the split locking ring expands in each locking profile and is subsequently pushed back again by the smooth upstream edge 93 of the profile.

After subsequent retrieval of the TFL diverter from the flowline circuit via the lubricator 43 the wellhead valves are opened again and production is resumed.

From the foregoing description it will be apparent that the flowline circuit and diverter tool according to the invention provide a system for deflecting TFL tools towards a desired well of a subsea production system without requiring permanently installed subsea diverter and actuator assemblies so that the amount of active subsea components is reduced to a minimum.

If desired a small diameter bypass conduit may be arranged between each branch line and a location of the main flowline downstream of the associated locking profile. These bypass conduits will induce the diverter tool to slow down at the location of each locking profile while it is pumped in a downstream direction through the main flowline so that a smooth landing of the split locking ring, if expanded, in the locking profile is accomplished.

Numerous other modifications of the diverter tool and flowline circuit shown in the drawing will become apparent to those skilled in the art upon reading of the foregoing description. Accordingly, it is to be clearly understood that the embodiments of the tool and circuit shown in the drawings are exemplary only.

What is claimed is:

1. A system for deflecting through-the flowline ("TFL") tools from a main flowline into a selected branch line, comprising a diverter tool which is movable through the main flowline and which is equipped with:

a torpedo-shaped central body;

a locking mechanism contained in the central body for positioning the diverter tool in the main flowline at a predetermined position near the selected branch line;

a TFL piston assembly connectable at one end of the central body;

a wedge-shaped diverter head connectable to the other end of the central body for guiding a TFL tool from the main flowline into selected branch line when the diverter tool is positioned at said location;

a bearing which connects an opposite end of the central body to the diverter head allowing free rotation of the diverter head relative to the central body; and means for orienting the diverter head in a predetermined orientation in the main flowline such that a smooth bore is formed from the main flowline into the branch line when the tool is positioned at said location.

2. The system of claim 1 wherein the diverter head has a cylindrical outer surface and a smoothly curved frontal surface which is oriented at a sharp angle relative to a central axis of said outer surface.

3. The system of claim 2 wherein said orienting means are formed by locating the center of gravity of the diverter head eccentrically relative to said central axis.

4. The system of claim 2 wherein the cylindrical outer surface of the diverter head is equipped with rollers for allowing free rotation of the diverter head inside the flowline.

5. The system of claim 1 wherein the locking mechanism comprises:

a ratcher mounted on a central shaft which is axially movable through the center of the central body and which is pulled towards a retracted position within the body by spring action;

a plurality of spring loaded cams which are pivotally connected to a linkage system within the central body such that they are in use pushed against the inner surface of the flowline and that teeth mounted on the linkage system engage teeth of the ratcher such that in use each time when the tool passes a branch line when it is pumped through the main flowline the shaft and ratcher move one tooth forward relative to the teeth of the linkage system and the shaft moves to its retracted position once the teeth of the linkage system have passed the last tooth of the ratcher; and a segmented locking ring which surrounds one end of the central body and which is pushed towards an expanded position by a series of levers once the shaft has moved to its retracted position.

6. The system of claim 5 wherein the central shaft and associated ratcher are mounted in a releasable manner in the central body.

7. A system for deflecting through-the-flowline ("TFL") tools from a main flowline into a selected branch line, comprising:

a diverter tool which is movable through the main flowline and which is equipped with:

a locking mechanism for positioning the diverter tool in the main flowline at a predetermined position near the selected branch line;

a wedge-shaped diverter head for guiding a TFL tool from the main flowline into the selected branch line when the diverter tool is positioned at said location;

means for orienting the diverter head in a predetermined orientation in the main flowline such that a smooth bore is formed from the main flowline into the branch line when the tool is positioned at said location;

a lubricator connected to an upstream end of the main flowline for launching the diverter tool;

a plurality of branch lines that are connected to the main flowline such that at the point of connection each branch line has a predetermined orientation relative to the main flowline; and a locking profile formed at the inner wall of the main flowline at a predetermined distance from each point of connection, said locking profile being mounted downstream of the branch line offtake and consisting of an annular groove with a sharp downstream edge on a smooth upstream edge shaped such that it is able to receive the locking mechanism of the diverter tool.

8. The system of claim 7 wherein at each point of connection the branch line has an upwardly directed orientation and the main flowline has a substantially horizontal orientation.

9. The system of claim 7 wherein a small diameter bypass conduit is arranged between each branch line and a location of the main flowline downstream of the associated locking profile.

10. The system of claim 7 wherein a return flowline is connected to the downstream end of the main flowline such that the main flowline and return flowline form a circuit through which fluid can be circulated and wherein a plurality of offtake lines are connected to the return flowline, each offtake line running parallel to a branch line into an oil or gas production well and being connected in fluid communication with this branch line at a downhole location within said well.

11. A system for deflecting TFL tools from a main flowline into a selected branch line, comprising:

a diverter tool which is movable through the main flowline, comprising:

a torpedo-shaped central body;

a locking mechanism in the torpedo-shaped central body for positioning the diverter tool in the main flowline at a predetermined position near the selected branch line;

a TFL piston assembly connected at an end of the central body;

a wedge-shaped diverter head for guiding a TFL tool from the main flowline into the selected branch line when the diverter tool is positioned at the predetermined position;

a bearing connecting the diverter head to an opposite end of the central body and allowing free rotation of the diverter head relative to the central body; and means for orienting the diverter head in a predetermined orientation in the main flowline such that a smooth bore is formed from the main flowine into the selected branch line when the diverter tool is positioned at the predetermined position.

12. The system of claim 11 wherein the diverter head comprises a cylindrical outer surface and a smoothly curved frontal surface which is oriented at a sharp angle relative to a central axis of said outer surface.

13. The system of claim 12 wherein said means for orienting are formed by locating the center of gravity of the diverter eccentrically relative to the central axis of the outer surface of the diverter head.

14. The system of claim 12 further comprising a plurality of rollers mounted at the cylindrical outer surface of the diverter head for allowing free rotation of the diverter head inside the main flowline.

15. The system of claim 11 wherein the locking mechanism comprises:

a central shaft;

a ratcher having a plurality of ratchet teeth mounted on the central shaft which is axially movable through the center of the central body and which is pulled towards a retracted position within the central body by spring action;

a linkage system within the central body;

teeth mounted in the linkage system;

a plurality of spring loaded cams which are pivotally connected to the linkage system such that they are in use pushed against the inner surface of the main flowline and that teeth mounted on the linkage system engage ratched teeth of the ratcher such that, in use, each time when the tool passes a branch line when it is pumped through the maim flowline the shaft and ratcher move one tooth forward relative to the teeth of the linkage system and the central shaft moves to its retracted position once the teeth of the linkage system have passed the last ratchet tooth;

a segmented locking ring which surrounds one end of the central body; and a series of levers which push the segmented locking ring towards an expanded position once the shaft has moved to its retracted position.

16. The system of claim 15 wherein the central shaft and associated ratcher are mounted in a releasable manner in the central body.

17. A system for deflecting TFL tools, comprising:

a diverting tool;

a locking mechanism carried by the diverter tool;

a main flowline;

a lubricator connected to an upstream end of the main flowline for launching the diverter tool;

a plurality of branch lines that are connected to the main flowline such that at the point of connection each branch line has a predetermined orientation relative to the main flowline;

a locking profile formed at the inner wall of the main flowline at a predetermined distance from each point of connection, said locking profile being mounted at one end of the branch lines downstream of its connection with the main flowline and consisting of an annular groove with a sharp downstream edge and a smooth upstream edge shaped such that it is able to receive the locking mechanism of the diverter tool;

a wedge-shaped diverter head for guiding the TFL tool from the main flowline into one of the branch lines when the locking mechanism carried on the diverter tool is received in the locking profile within the main flowline; and means for orienting the diverter head in a predetermined orientation in the main flowline such that a smooth bore is formed from the main flowline into the branch line.

18. The system of claim 17 wherein each point of connection the branch line has an upwardly directed orientation and the main flowline has a substantially horizontal orientation.

19. The system of claim 17 wherein a small diameter bypass conduit is arranged between each branch line and a location of the main flowline downstream of the associated locking profile.

20. The system of claim 17 further comprising:

a return flowline connected to the downstream end of the main flowline;

a circuit through which fluid can be circulated formed by the main flowline and return flowline; and a plurality of offtake lines connected to the return flowline, each offtake line running parallel to one of the branch lines into an oil or gas production well and being connected in fluid communication with said branch line at a downhole location within said well.

21. A system for deflecting TFL tools from a main flowline into a selected branch line, comprising:

a diverter tool which is movable through the main flowline, comprising:

a locking mechanism for positioning the diverter tool, said locking mechanism engaging across the main flowline at a predetermined position near the selected branch line;

a wedge-shaped diverter head for guiding a TFL tool from the main flowline into the selected branch line when the diverter tool is positioned at the predetermined position; and means for orienting the diverter head in a predetermined orientation in the main flowline such that a smooth bore is formed from the main flowline into the selected branch line when the diverter tool is positioned at the predetermined position.

22. A system for deflecting TFL tools, comprising:

a diverting tool;

a locking mechanism carried by the diverter tool;

a main flowline;

a lubricator connected to the main flowline for launching the diverter tool;

a plurality of branch lines that are connected to the main flowline such that at the point of connection each branch line has a predetermined orientation relative to the main flowline;

a locking profile formed at the inner wall of the main flowline at a predetermined distance from each point of connection, said locking profile being shaped such that it is able to receive the locking mechanism of the diverter tool in placement across the main flowline;

a wedge-shaped diverter head for guiding the TFL tool from the main flowline into one of the branch lines when the locking mechanism carried on the diverter tool is received in the locking profile within the main flowline; and means for orienting the diverter head in a predetermined orientation in the main flowline such that a smooth bore is formed from the main flowline into the branch line.

* * * * *